US006559610B2

(12) United States Patent
Tanaka

(10) Patent No.: US 6,559,610 B2
(45) Date of Patent: May 6, 2003

(54) CONTINUOUS WAVE ELECTRON-BEAM ACCELERATOR AND CONTINUOUS WAVE ELECTRON-BEAM ACCELERATING METHOD THEREOF

(75) Inventor: Hirofumi Tanaka, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/801,046

(22) Filed: Mar. 8, 2001

(65) Prior Publication Data

US 2002/0008450 A1 Jan. 24, 2002

(30) Foreign Application Priority Data

Mar. 9, 2000 (JP) ..... 2000-064533
Dec. 18, 2000 (JP) ..... 2000-383067

(51) Int. Cl.[7] ..... H05H 13/10

(52) U.S. Cl. ..... 315/506; 315/507; 315/500; 315/5.41; 315/5.42; 315/111.61; 250/492.1; 250/493.1

(58) Field of Search ..... 315/506, 507, 315/500, 5.41, 5.42, 111.61; 250/492.1, 493.1

(56) References Cited

U.S. PATENT DOCUMENTS 5,436,537 A * 7/1995 Hiramoto et al. ..... 315/507
5,477,056 A * 12/1995 Hirota et al. ..... 250/492.2

OTHER PUBLICATIONS

Washio, M., et al.; "Simulations of Racetrack Microtron for Acceleration of Picosecond Electron Pulse", *Proceedings of the 1999 Particle Accelerator Conference*, pp. 2298–2300, New York (1999).

"Development of Small–sized Synchrotron Radiation Source 'AURORA'", *Sumitomo Jukikai* (*Heavy Industries*) *Giho*, (Technical Report), vol. 39, No. 116, pp. 2–10 (1991). Abstract only.

* cited by examiner

*Primary Examiner*—Bruce Anderson
*Assistant Examiner*—Nikita Wells
(74) *Attorney, Agent, or Firm*—Leydig, Voit & Mayer, Ltd.

(57) ABSTRACT

A continuous wave electron-beam accelerator that accelerates a continuous wave electron beam having a large average current includes an electron beam generator, an electron-beam accelerating unit using a radio-frequency electric field having a frequency of approximately 500 MHz to accelerate an continuous wave electron beam, and electron-beam bending units located across the electron-beam accelerating unit and that bend the continuous wave electron beam a number of times. Each electron-beam bending unit includes divided magnets having identical-polarity magnetic fields, and controls the continuous wave electron beam so that the beam passes through the electron-beam acceleration unit a number of times on almost the same path.

9 Claims, 9 Drawing Sheets

CONTINUOUS WAVE ELECTRON-BEAM ACCELERATOR AND CONTINUOUS WAVE ELECTRON-BEAM ACCELERATING METHOD THEREOF

BACKGROUND OF THE INVENTION

1. Field of the Invention

The present invention relates to continuous wave electron-beam accelerators and continuous wave electron-beam accelerating methods thereof, and in particular, to continuous wave electron-beam accelerators for accelerating high intensity continuous wave electron beams particularly sludge for use in food irradiation, irradiation for quarantine, sludge processing, drainage processing, medical sterilization, the generation of low energy positrons, etc., and continuous wave electron-beam accelerating methods thereof.

2. Description of the Related Art

FIG. 10 shows a conventional electron-beam accelerator as described in, for example, Takahashi and Yamada, "Development of Small-sized Synchrotron Radiation Source 'AURORA'", Sumitomo Jukikai (Heavy Industries) Giho (Technical Report), Vol. 39, No. 116, 1991, pp. 2–10. This type of electron-beam accelerator is called a "race-track microtron". FIG. 10 shows an electron gun 111, an injection electromagnet 112, a radio frequency cavity (linac) 113, bending electromagnets 114, and electron beam orbits 115.

The operation of the conventional electron-beam accelerator is described below.

An electron beam is generated by the electron gun 111. The generated electron beam is a pulsed beam having a frequency of several hertz to several hundred hertz and a pulse width of ten nanoseconds to several microseconds.

The generated electron beam is injected into the electron-beam accelerator by the injection electromagnet 112. In the electron-beam accelerator, the electron beam is accelerated whenever it passes through the radio frequency cavity 113 while passing along the electron beam orbits 115. The electron-beam accelerator accelerates the electron beam by mainly using an S-band radio-frequency electric field (approximately 2.8 GHZ). When the electron beam passes through the radio frequency cavity 113 once, it usually obtains an energy of approximately 5 MeV. In order to form the electron beam orbits 115, the bending electromagnets 114 are disposed across the radio frequency cavity 113.

In the electron-beam accelerator, the acceleration phase of the electron beam each time it circumferentially passes through the radio frequency cavity 113 is uniquely determined by an expression of the relationship between an acceleration voltage in the radio frequency cavity 113 and the magnetic field strength of the bending magnets 114. Accordingly, to enable the acceleration of the electron beam up to a high energy level, two conditions must be satisfied: (1) energy gain obtained when the electron beam passes through the radio frequency cavity 113 is close to a multiple of the electron rest energy (approximately 511 keV), and (2) the speed of the electron beam is close to the speed of light.

When the injection energy of the electron beam is low, the speed of the electron beam is much smaller than the speed of light (for example, when the injection energy is 80 keV, the electron beam speed is approximately half of the speed of light), the above conditions do not hold. In addition, when the energy gain obtained when the electron beam passes through the radio frequency cavity 113 is small, the number of circumferential passes of the electron beam until its speed approaches the speed of light increases, which causes a problem in that acceleration is difficult since a shift from the acceleration phase increases during the circumferential passes. Accordingly, the conventional electron-beam accelerator must be operated using parameters in which, by raising the acceleration voltage of the radio frequency cavity 113, the electron beam speed almost reaches the speed of light when the electron beam is allowed to pass through the radio frequency cavity 113 once or slightly more.

In order to increase the acceleration voltage per unit length, the frequency of a radio frequency electric field applied to the radio frequency cavity 113 must be increased to approximately 1 GHz to 3 GHz. In order to increase the acceleration voltage of the radio frequency cavity 113 when the frequency of the radio frequency electric field is smaller than this value, the size of the radio frequency cavity 113 must be increased. This is because, while the electron beam passes through the radio frequency cavity 113, it has a deceleration phase and can hardly be accelerated since a shift of the phase of the electron beam from the radio frequency acceleration electric field rapidly increases.

A radio frequency cavity having a radio frequency of 1 GHz to 3 GHz causes a problem in that it is difficult to accelerate a continuous wave electron beam having a large average current since the size of the radio frequency cavity is inevitably small and it is difficult to remove heat generated when high power is supplied. Therefore, it is difficult to apply electron-beam accelerators having a radio frequency cavity of this type to purposes requiring a high intensity continuous wave electron beam, such as food irradiation, irradiation for quarantine, sludge processing, drainage processing, medical sterilization, and generation of low energy positrons.

In the conventional electron-beam accelerator, the microtron acceleration condition must be satisfied such that the energy gain for each circumferential pass of the electron beam must be approximately a multiple of the electron rest energy (approximately 511 keV). Thus, a problem occurs in that electrical efficiency cannot be increased due to parameter limitation.

SUMMARY OF THE INVENTION

Accordingly, the present invention is made for solving the foregoing problems. A first object of the present invention is to provide a continuous wave electron-beam accelerator for accelerating an electron beam having a large average current and a continuous wave accelerating method thereof.

A second object of the present invention is to provide a continuous wave electron-beam accelerator in which an electron beam is accelerated without satisfying the condition that the energy gain for each circumferential pass of an electron beam must be approximately a multiple of the electron rest energy, which is required in microtron acceleration and in which parameters have more degrees of freedom, resulting in an increase in electrical efficiency, and a continuous wave electron-beam accelerating method thereof.

According to an aspect of the present invention, a continuous wave electron-beam accelerator includes an electron-beam generating unit for generating a continuous wave electron beam, an electron-beam accelerating unit for accelerating the continuous wave electron beam, a first electron-beam bending unit that is provided close to one end of the electron-beam accelerating unit and that bends the accelerated continuous wave electron beam, and a second electron-beam bending unit that is provided close to the other end of the electron-beam accelerating unit and that bends the accelerated continuous wave electron beam. Each of the first electron-beam bending unit and the second electron-beam bending unit includes a first bending electromagnet having a surface opposed to one side of the electron-beam accelerating unit, a second bending electromagnet and a third bending electromagnet which are discretely provided opposing another surface of the first bending electromagnet. The first bending electromagnet is made of a reverse bending electromagnet having a polarity opposite to that of the second bending electromagnet or the third bending electromagnet. The second bending electromagnet has a polarity identical to that of the third bending electromagnet, and has a first magnetic field strength different from that of the third bending electromagnet. The third bending electromagnet has a polarity identical to that of the second bending electromagnet, and has a second magnetic field strength different from that of the second bending electromagnet.

The present invention also provides a continuous wave electron-beam accelerator including an electron-beam generating unit for generating a continuous wave electron beam, an electron-beam accelerating unit for accelerating the continuous wave electron beam, and an electron-beam bending unit for bending the accelerated continuous wave electron beam. The electron-beam bending unit includes a first electron-beam bending unit that is provided close to one end of the electron-beam accelerating unit and that bends the accelerated continuous wave electron beam, a second electron-beam bending unit that is provided close to the other end of the electron-beam accelerating unit and that bends the accelerated continuous wave electron beam, and a third electron-beam bending unit that is provided between the first electron-beam bending unit and the second electron-beam bending unit at a straight portion opposed to the electron-beam accelerating unit, and that generates dipole magnetic fields for adjusting the length of the circumferential path of the continuous wave electron beam when the continuous wave electron beam passes through the magnetic fields.

According to the above-described continuous wave electron-beam accelerators, it is possible to select, for the electron-beam accelerating unit, a radio-frequency electric field having a low acceleration frequency. This enables the acceleration of a continuous wave electron beam having a large average current.

In addition, without satisfying the condition that the energy gain for each circumferential pass must be approximately a multiple of the electron rest energy, which is essential in the microtron acceleration, the continuous wave electron beam can be accelerated, and the parameter has more degrees of freedom. As a result, the electrical efficiency can be increased. Moreover, the loss caused by the wall in the electron-beam accelerating unit can be decreased, which increases the electrical efficiency.

According to another aspect of the present invention, a continuous wave electron-beam accelerating method for a continuous wave electron-beam accelerator includes an electron-beam generating unit for generating a continuous wave electron beam, an electron-beam accelerating unit for accelerating the continuous wave electron beam, a first electron-beam bending unit that is provided close to one end of the electron-beam accelerating unit and that bends the accelerated continuous wave electron beam, and second electron-beam bending unit that is provided close to the other end of the electron-beam accelerating unit and that bends the accelerated continuous wave electron beam. The continuous wave electron-beam accelerating method includes the steps of (a) adjusting the acceleration phase of the continuous wave electron beam, which is injected into the electron-beam accelerating unit, by adjusting the difference between the phase of the continuous wave electron beam in the electron-beam generating unit and the phase of an acceleration electric field in the electron-beam accelerating unit, (b) adjusting the acceleration phase of the continuous wave electron beam, which is injected into the electron-beam accelerating unit, by adjusting the distance between the electron-beam accelerating unit and the first electron-beam bending unit, (c) adjusting the acceleration phase of the continuous wave electron beam, which is injected into the electron-beam accelerating unit, by adjusting the distance between the first electron-beam bending unit and the second electron-beam bending unit, and (d) adjusting the acceleration phase of the continuous wave electron beam, which is injected into the electron-beam accelerating unit, by adjusting a ratio between the magnetic field strengths of identical-polarity bending electromagnets provided in the first electron-beam bending unit and the second electron-beam bending unit, and the bending angles thereof.

The present invention also provides a continuous wave accelerating method for a continuous wave electron-beam accelerator including an electron-beam generating unit for generating a continuous wave electron beam, an electron-beam accelerating unit for accelerating the continuous wave electron beam, a first electron-beam bending unit that is provided close to one end of the electron-beam accelerating unit and that bends the accelerated continuous wave electron beam, a second electron-beam bending unit that is provided close to the other end of the electron-beam accelerating unit and that bends the accelerated continuous wave electron beam, and a third electron-beam bending unit that is provided between the first electron-beam bending unit and the second electron-beam bending unit so as to be opposed to the electron-beam accelerating unit, and that generates dipole magnetic fields for adjusting the length of the circumferential path of the continuous wave electron beam which passes through the magnetic fields. The continuous wave accelerating method includes the steps of (a) adjusting the acceleration phase of the continuous wave electron beam, which is injected into the electron-beam accelerating unit, by adjusting the difference between the phase of the continuous wave electron beam in the electron-beam generating unit and the phase of an acceleration electric field in the electron-beam accelerating unit, (b) adjusting the acceleration phase of the continuous wave electron beam, which is injected into the electron-beam accelerating unit, by adjusting the distance between the electron-beam accelerating unit and the first electron-beam bending unit, (c) adjusting the acceleration phase of the continuous wave electron beam, which is injected into the electron-beam accelerating unit, by adjusting the distance between the first electron-beam bending unit and the second electron-beam bending unit, and (d) adjusting the acceleration phase of the continuous wave electron beam, which is injected into the electron-beam accelerating unit, by adjusting the length of the path of the continuous wave electron beam each time the continuous wave electron beam circumferentially passes.

According to the above-described continuous wave accelerating methods, without satisfying the condition that the energy gain for each circumferential pass must be approximately a multiple of the electron rest energy, which is essential in the microtron acceleration, a continuous wave electron beam can be accelerated.

The foregoing and other objects, features, aspects, and advantages of the present invention will become more apparent from the following detailed description of the present invention when taken into conjunction with the accompanying drawings.

DESCRIPTION OF THE PREFERRED EMBODIMENTS

First Preferred Embodiment

Figure 1:
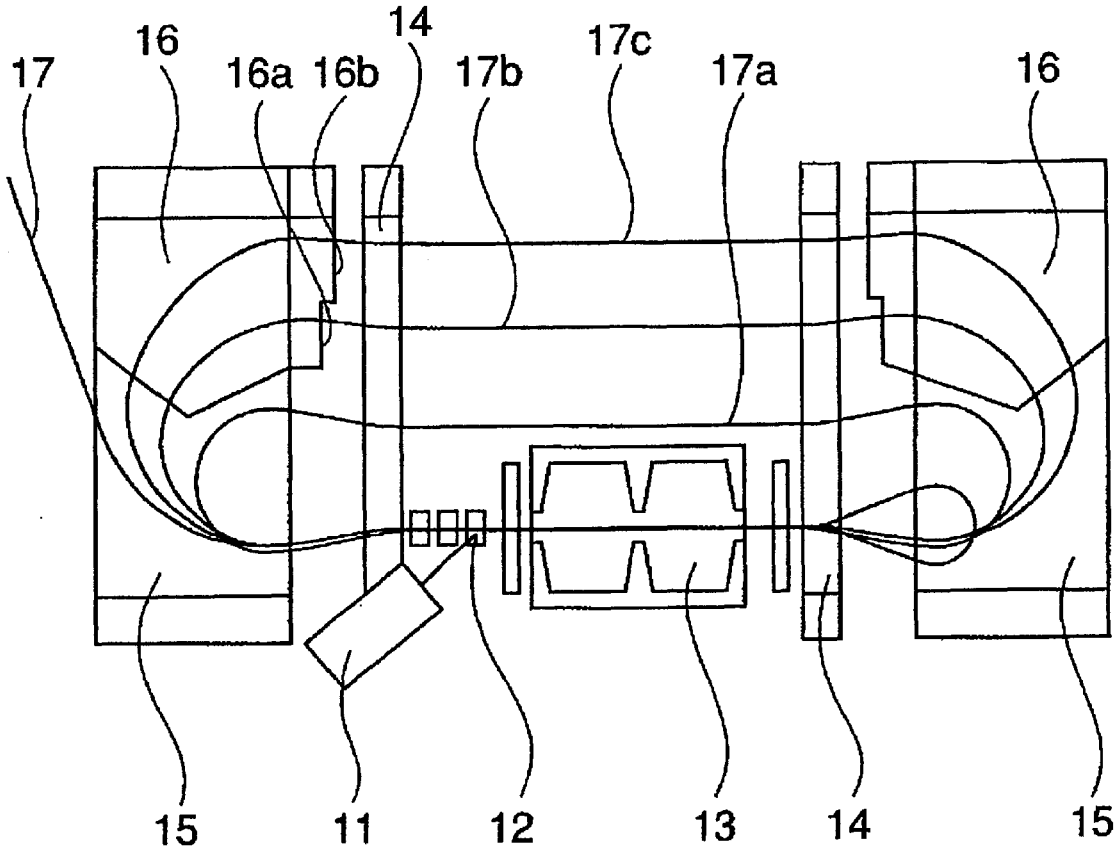
FIG. 1 is a schematic drawing showing a continuous wave electron-beam accelerator according to a first preferred embodiment of the present invention.

FIG. 1 shows the schematic structure of a continuous wave electron-beam accelerator according to a first preferred embodiment of the present invention. Specifically, FIG. 1 shows the schematic structure of a plane (path plane) on which a continuous wave electron beam of the continuous wave electron-beam accelerator is accelerated. The continuous wave electron-beam accelerator includes an electron beam generator 11 for generating a continuous wave electron beam, an electron-beam injection unit 12 on which the generated electron beam is injection, an electron-beam accelerating unit (radio frequency cavity) 13 for accelerating the injection continuous wave electron beam. The electron-beam accelerating unit 13 consists of two cells (acceleration gaps) in the first embodiment.

The continuous wave electron-beam accelerator also includes two electron-beam bending units that form continuous wave electron beam paths 17 by bending the accelerated continuous wave electron beam from the electron-beam accelerating unit 13 so that its passing direction changes. The two electron-beam bending units are provided close to ends of the electron-beam accelerating unit 13. The two electron-beam bending units consist of a first electron-beam accelerating unit (shown on the right side in FIG. 1) that is provided close to an end of the electron-beam accelerating unit 13 and that bends the accelerated continuous wave electron beam, and a second electron-beam bending unit (shown on the left side in FIG. 1) that is provided close to the other end of the electron-beam accelerating unit 13 on a side with the electron beam generator 11 and that bends the accelerated continuous wave electron beam.

Each of the first and second electron-beam bending units includes a first bending electromagnet 14 having a surface opposed to one side of the electron-beam accelerating unit 13, and a second bending electromagnet 15 and a third bending electromagnet 16 that are discretely provided opposing the other surface of the first bending electromagnet 14. The first bending electromagnet 14 is made of a reverse bending electromagnet having a polarity different from that of the second and third bending electromagnets 15 and 16. The first bending electromagnet 14 operates so that it controls a continuous wave electron beam that has passed through it the first time to pass reversely through it on the same path again and so that it maintains the beam size of the circumferentially passing continuous wave electron beam in a predetermined range.

The second bending electromagnet 15 has a polarity identical to that of the third bending electromagnet 16, and has a magnetic field strength different from that of the third bending electromagnet 16. The third bending electromagnet 16 has a polarity identical to that of the second bending electromagnet 15, and has a magnetic field strength different from that of the second bending electromagnet 15.

In the first embodiment, the magnetic field strength of the third bending electromagnet 16 is set to be weaker than that of the second bending electromagnet 15. Accordingly, in order to maintain the path 17 of the continuous wave electron beam, which is opposed to the electron-beam accelerating unit 13, in almost parallel to the electron-beam accelerating unit 13, the length of the path inside the third bending electromagnet 16 must be lengthened, so that a continuous wave-electron-beam-exit portion of the third bending electromagnet 16 is formed to have a magnetic pole in a stepped shape like 16*a* and 16*b* shown in FIG. 1. In the first embodiment, the right and left continuous wave electron-beam bending units are almost identical in shape and are symmetrically provided.

In the vicinity of a portion of the continuous wave electron-beam accelerator from which the electron beam is led, the shapes of the right and left continuous wave electron-beam bending units may be modified for adjusting the direction in which the electron beam is led.

As described above, by forming surfaces of the second and third bending electromagnets 15 and 16 which are opposed to the first bending electromagnet 15 so that they have a stepped magnetic pole shape, the paths of the continuous wave electron beam which are opposed to the electron-beam accelerating unit 13 can be maintained to be almost in parallel to the electron-beam accelerating unit 13, whereby a continuous wave electron beam having a significantly broad acceleration-phase width can be accelerated.

Although the stepped-magnetic-pole portion extends as denoted by 16*a* and 16*b* in FIG. 1, there may be a case in which the length of the path inside the third bending electromagnet 16 must be shortened depending on parameters. In this case, the exit portion of the third bending electromagnet 16 is a magnetic pole having a denting stepped shape.

Parameters of the first, second, and third bending electromagnets 14, 15, and 16 are adjusted so that the paths 17 of the continuous wave electron beam are almost identical in the electron-beam accelerating unit 13. In the first embodiment, after the continuous wave electron beam passes through the electron-beam accelerating unit 13 five times, it is led from the continuous wave electron-beam accelerator to the exterior.

In the first embodiment, the continuous wave electron-beam accelerator that accelerates electrons up to, for example, 5 MeV, is described below.

In the present invention, the continuous wave electron beam is a continuous electron beam having a very high radio frequency of 500 MHz. An accelerator that accelerates this type of beam is generally called a "continuous wave accelerator" by researchers. The electron-beam accelerating unit 13 uses a radio frequency cavity that is normally used in a high energy accelerator. In the first embodiment, it is assumed that an acceleration voltage of approximately 1 MV is used. The acceleration of the continuous wave electron beam is performed by the electron-beam accelerating unit 13. To accelerate a continuous wave electron beam having an average current in the order of several tens of kilowatts to several hundred kilowatts, high intensity power must be supplied to the electron-beam accelerating unit 13. Accordingly, a radio-frequency electric field having a frequency of approximately 900 MHz or less is supplied to the electron-beam accelerating unit 13.

By supplying the radio-frequency electric field, heat is generated by an electric resistance of the wall of the radio frequency cavity used in the electron-beam accelerating unit 13. Since a predetermined radio-frequency electric field cannot be supplied if the size of the radio frequency cavity changes due to the heat, the heat must be removed. Power that can be supplied to the radio frequency cavity is correlative with a size allowing the heat to be removed. Normally, the larger the size of the radio frequency cavity, the greater power can be supplied. To increase the size of the radio frequency cavity, the frequency of the radio-frequency electric field must be decreased. In general, the radio frequency cavity has a size proportional to the wavelength of the supplied radio-frequency electric field. Since the wavelength is inversely proportional to the frequency, the frequency of the radio-frequency electric field must be decreased in order to increase the size of the radio frequency cavity.

The lower the frequency of the radio-frequency electric field, the greater the size of the electron-beam accelerating unit 13 and the larger the size of the electron-beam accelerator. The lower the frequency of the radio-frequency electric field, the smaller the energy gains per unit length of the electron beam. Also, the lower the frequency of the radio-frequency electric field, the easier the removal of power lost by the cavity wall. Accordingly, a frequency to select is determined by the trade-off between the radio-frequency electric field and the length of the radio frequency cavity. To accelerate a continuous wave electron beam having a large average current, a radio-frequency electric field having a lower acceleration frequency must be selected. As in the first embodiment, for the acceleration of the radio-frequency electric field having an average current in the order of several tens of kilowatts to several hundred kilowatts, it is preferable to use a radio frequency cavity having a frequency of 900 MHz or lower.

A high acceleration voltage in the electron-beam accelerating unit 13 increases the loss caused by the wall. In general, the loss caused by the wall is proportional to the square of an acceleration voltage. Since it is preferable that power required by the continuous wave electron-beam accelerator be small, a low acceleration voltage is preferable to reduce the loss caused by the wall. In the first embodiment, the injection energy in the continuous wave electron-beam accelerator is approximately 100 keV or lower. Thus, a difference between the speed of electrons in low energy state and the speed of light cannot be ignored. When the length of the radio frequency cavity is lengthened with the acceleration voltage decreased, the continuous wave electron beam cannot be accelerated because the difference causes the continuous wave electron beam to shift from the phase of the radio-frequency electric field during the acceleration. Therefore, the acceleration voltage is not allowed to be decreased below a predetermined value or lower, so that the required acceleration voltage is limited to a certain range if the frequency of the radio-frequency electric field for acceleration has been determined.

For the above-described reasons, in the continuous wave electron-beam accelerator according to the first embodiment, when the acceleration of the continuous wave electron beam having an average current in the order of several tens of kilowatts to several hundred kilowatts is considered, the acceleration frequency of the electron-beam accelerating unit 13 is limited to approximately 900 MHz or lower. Also, the acceleration voltage, the number of cells of the radio frequency cavity, etc., are each limited to a certain range.

By way of example, when a frequency of 500 MHz is selected, for acceleration up to 5 MeV, it is preferable to use the condition that the electron-beam accelerating unit 13 includes two cells, the acceleration voltage is set to 1 MV, and the electron beam passes through the radio frequency cavity about five times. In this case, the loss caused by the wall in the electron-beam accelerating unit 13 is approximately 60 kW. For accelerating a 30-kW electron beam, a radio-frequency power supply must output approximately 90 kW to 100 kw. As the radio-frequency power supply, for example, a klystron power supply, a inductive output tube (IOT) power supply, or the like, may be used.

The speed of the continuous wave electron beam in low energy region is not regarded the speed of light, and changes whenever it circumferentially passes. Energy, obtained when the continuous wave electron beam passes through the electron-beam accelerating unit 13, differs depending on each time. This is because the frequency of the radio-frequency electric field applied to the electron-beam accelerating unit 13 is constant and the speed of the passing continuous wave electron beam differs depending on each circumferential pass. Accordingly, in the conventional continuous wave electron-beam accelerator, by decreasing the acceleration frequency, and reducing the energy gain obtained when the electron beam passes through the radio frequency cavity, the electron beam shifts from the acceleration phase and the practicable acceleration phase width extremely narrows. This makes it impossible to perform acceleration, and even if the acceleration is possible, it is difficult to accelerate a continuous wave electron beam having a large average current.

To solve the above problems, according to the first embodiment, in each electron-beam bending unit, a magnet for main bending is divided into the second bending electromagnet 15 and the third bending electromagnet 16, which have the same polarity and different magnetic field strengths. The acceleration phase of the continuous wave electron beam passing through the electron-beam accelerating unit 13 is adjusted as described below. Since an optimal acceleration phase of the continuous wave electron beam passing through the electron-beam accelerating unit 13 differs depending on each circumferential pass, the length of the circumferential path for each circumferential pass is controlled by the following steps:

(a) when the continuous wave electron beam is injected into the electron-beam accelerating unit 13 the first time, the difference between the phase of the continuous wave electron beam by the electron beam generator 11 and the phase of the acceleration electric field by the electron-beam accelerating unit 13 is adjusted;

(b) when the continuous wave electron beam is injected into the electron-beam accelerating unit 13 the second time, the distance between the electron-beam accelerating unit 13 and the first electron-beam bending unit 14,15,16 is adjusted;

(c) when the continuous wave electron beam is injected into the electron-beam accelerating unit 13 the third time, the distance between the first electron-beam bending unit 14,15,16 and the second electron-beam bending unit 14,15,16 is adjusted; and (d) when the continuous wave electron beam is injected into the electron-beam accelerating unit 13 the fourth time and the fifth time, the length of the circumferential path is adjusted by adjusting the ratio of magnetic field strengths in the same polarity bending magnets (the second and third bending electromagnets 15,16), and the bending angles thereof.

The adjustment of the acceleration phase of the continuous wave electron beam in the steps (a), (b), and (c) is possible since it is performed by timing adjustment for the continuous wave electron beam, and the adjustment of the positions of the electron beam generator 11, the electron-beam accelerating unit 13, and the first, second, and third bending electromagnets 14, 15, and 16. A computer-simulation result about whether the adjustment of the acceleration phase of the direct-current electron beam in step (d) is possible is described below.

The paths 17 shown in FIG. 1 of the continuous wave electron beam are one example of an acceleration path obtained as a result of the simulation, and shows the result of simulating the central path of the continuous wave electron beam in the case where the acceleration phase of the continuous wave electron beam for the fifth pass is shifted by 55 degrees from the acceleration phase of the continuous wave electron beam obtained when the electron-beam bending units according to the present invention are not employed. The path 17*b* for the fourth pass of the continuous wave electron beam that passes outside the electron-beam accelerating unit 13 is greatly separated from the path 17*c* for the fifth pass of the continuous wave electron beam.

Since the separation between the paths 17*b* and 17*c* of the continuous wave electron beam is sufficiently large, a distance between the path 17*a* for the third pass of the continuous wave electron beam that passes only through the second bending electromagnet 15, and the path 17*b* for the fourth pass of the continuous wave electron beam that passes through the second and third bending electromagnets 15 and 16 is approximately 20 centimeters in the magnet-dividing portion. This distance can be obtained by providing electromagnets having different magnetic pole gaps.

Figure 2:
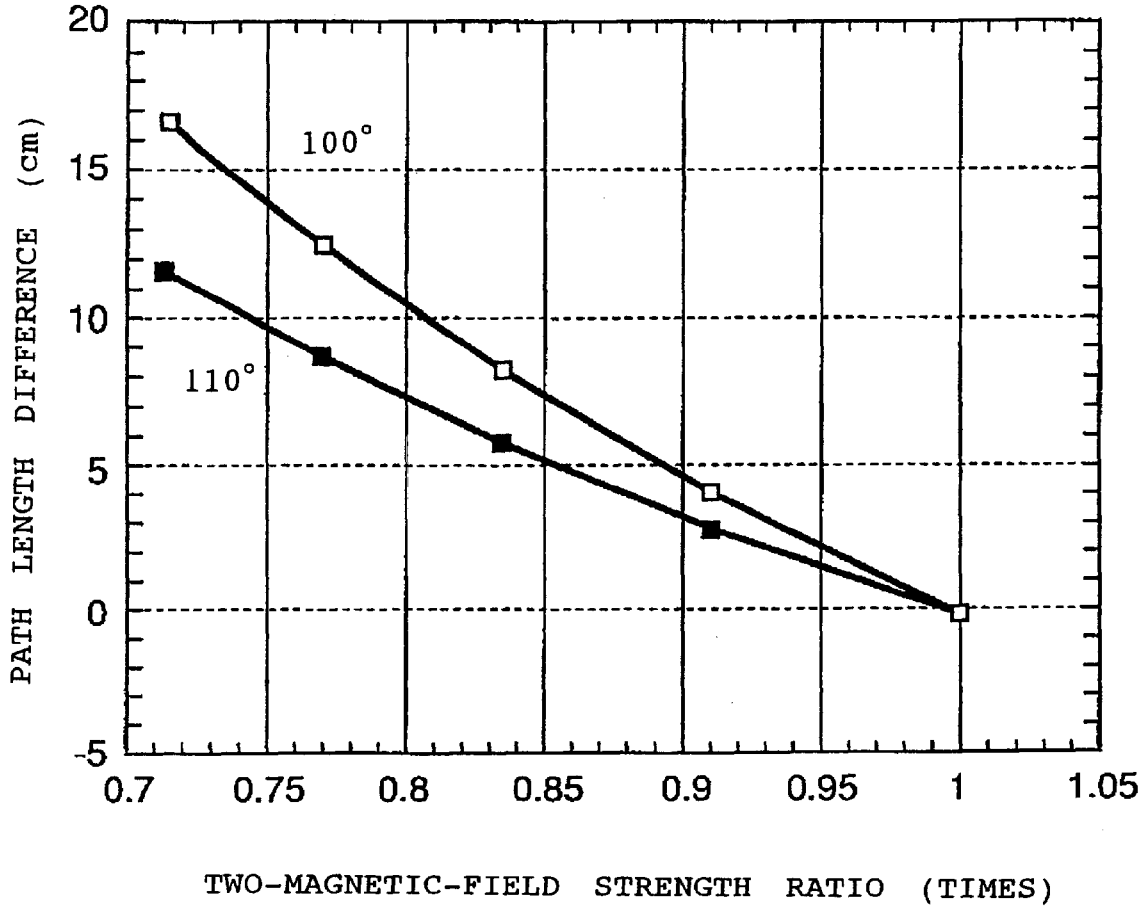
FIG. 2 is a graph illustrating the relative ratio between the magnetic field strengths of a second bending electromagnet and a third bending electromagnet, and the difference between the lengths of circumferential paths, which are obtained by beam simulation.

FIG. 2 shows the relationship between a two-magnetic-field strength ratio and a path length difference, which is obtained when the bending electromagnet is divided into two bending electromagnets 15 and 16. The path length difference is defined as a difference in the length of one circumferential path between the case where a uniform undivided bending electromagnet is used and the case where two divided bending electromagnets 15 and 16 are used as in the first embodiment. In FIG. 2, 100 degrees and 110 degrees indicate bending angles of the second bending electromagnet 15. According to another discussion, to realize the two divided bending magnets 15 and 16, the bending angle of the second bending electromagnet 15 must be set at approximately 100 degrees or greater.

In order to accelerate the electron beam up to 5 MeV in the first embodiment, it is found based on the result of another simulation that the path length must be approximately 7 centimeters longer than that in the case where the two divided bending electromagnets are not used. In other words, it is required to create the condition that the path length difference (the vertical axis) shown in FIG. 2 is 7 centimeters. From FIG. 2, it is understood that the above condition can be created by using a value that is 0.85 or less times the magnetic field strength ratio of the two divided bending electromagnets when the bending angle of the second bending electromagnet 15 is 100 degrees, and it is understood that the above condition can be created by using a value that is 0.8 or less times the magnetic field strength ratio of the two divided bending electromagnets when the bending angle of the second bending electromagnet 15 is 110 degrees. These values can be achievable in electromagnet design.

Figure 3:
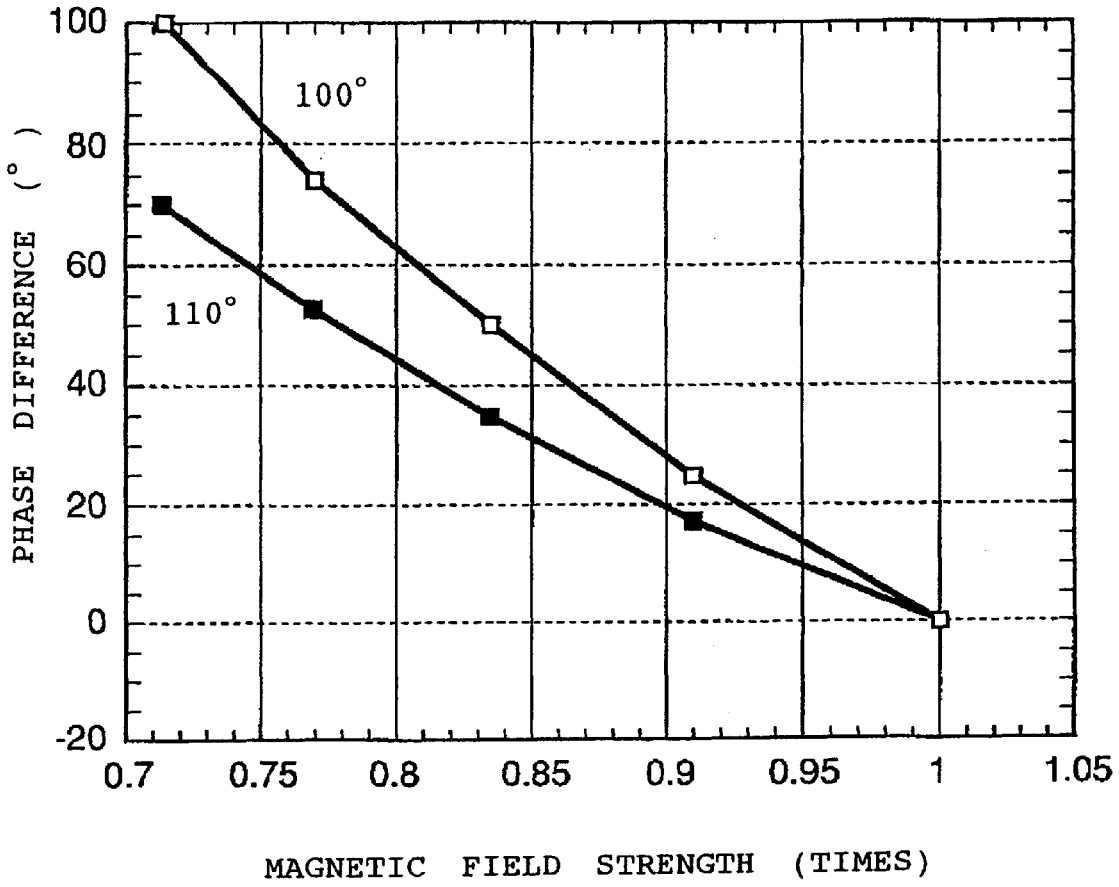
FIG. 3 is a graph illustrating the relative ratio between the magnetic field strengths of a second bending electromagnet and a third bending electromagnet, and an acceleration-phase adjusting range, which are obtained by beam simulation.

FIG. 3 shows the relationship between the magnetic field strength and the phase difference (a shift from the acceleration phase when the two divided bending electromagnets are not used) that is indicated by the vertical axis. From the result of another simulation, it is found that stable acceleration up to approximately 5 MeV can be performed with a phase difference of approximately 42 degrees formed. From FIG. 3, it is found that the above condition can be created by using a value that is 0.85 or less times the magnetic field strength ratio of the two divided bending electromagnets when the bending angle of the second bending electromagnet 15 is 100 degrees, and it is understood that the above condition can be created by using a value that is 0.8 or less times the magnetic field strength ratio of the two divided bending electromagnets when the bending angle of the second bending electromagnet 15 is 110 degrees.

Figure 4:
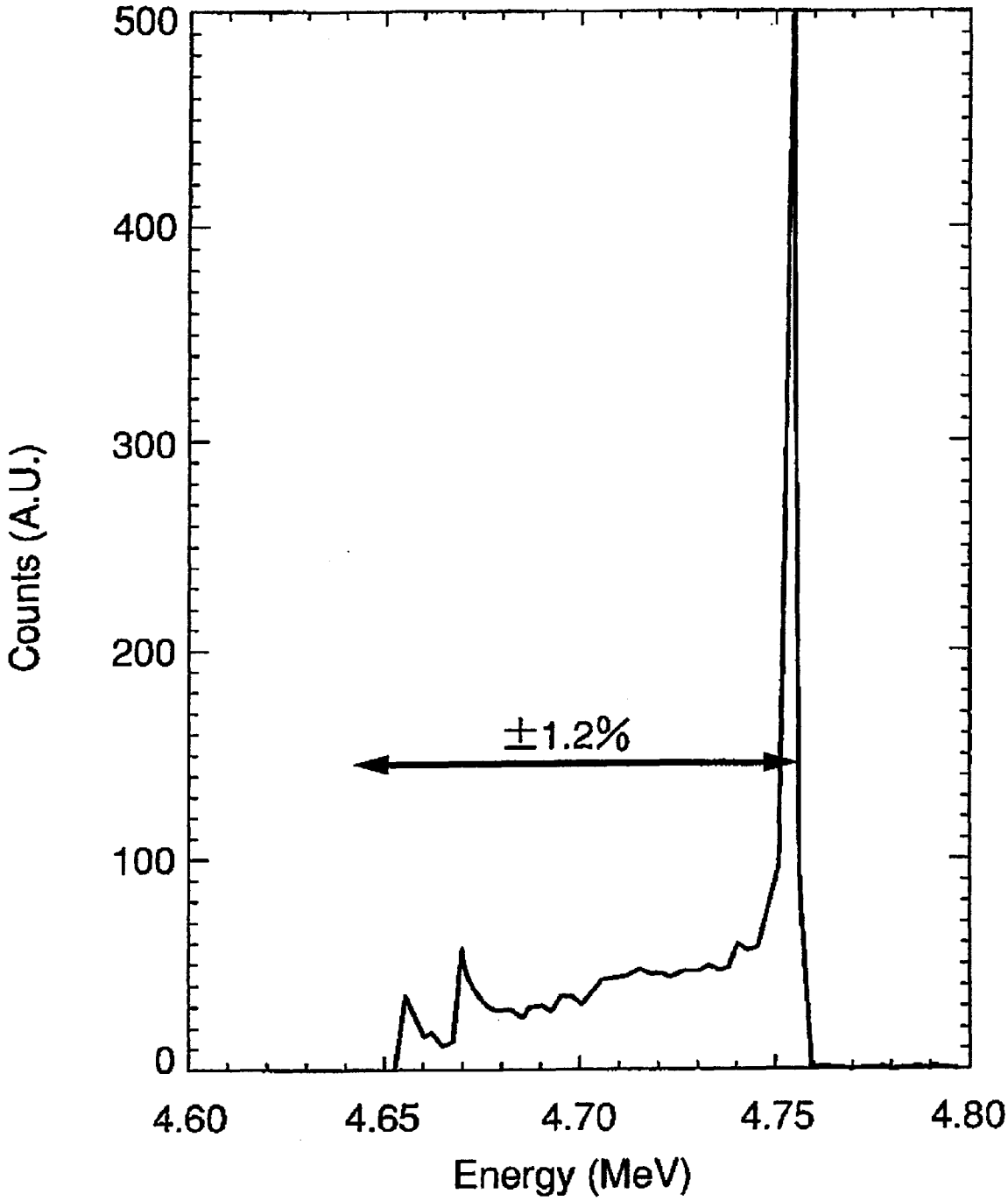
FIG. 4 is a graph illustrating a calculated energy spectrum of an electron beam at the exit position of the continuous wave electron-beam accelerator shown in FIG. 1.

FIG. 4 shows an energy spectrum of an electron beam ejected from the continuous wave electron-beam accelerator in which the energy spectrum is calculated based on simulation of the behavior of the electron beam until it is ejected from the exit of the continuous wave electron-beam accelerator in the first embodiment. From FIG. 4, it is understood that the continuous wave electron beam can be accelerated with an energy dispersion of ±1.2% maintained. Although the calculation result indicates that the final acceleration energy is approximately 4.7 MeV, it is found based on similar simulation that the acceleration energy can be easily increased up to 5 MeV by increasing the voltage of the electron-beam accelerating unit 13.

As described above, according to the first embodiment, there is provided a continuous wave electron-beam accelerator including the electron beam generator 11 for generating a continuous wave electron beam, the electron-beam accelerating unit 13 for accelerating the continuous wave electron beam, the first electron-beam bending unit that is provided close to one end of the electron-beam accelerating unit 13 and that bends the accelerated continuous wave electron beam, and the second electron bending unit that is provided close to the other end of the electron-beam accelerating unit 13 and that bends the accelerated continuous wave electron beam. The first and second electron-beam bending units each include the first bending electromagnet 14 having a surface opposed to one side of the electron-beam accelerating unit 13, and the second bending electromagnet 15 and the third bending electromagnet 16 that are discretely provided opposing another surface of the first bending electromagnet 14. The first bending electromagnet 14 is made of a reverse bending electromagnet having a polarity different from that of the second bending electromagnet 15 and the third bending electromagnet 16. The second bending electromagnet 15 has a polarity identical to that of the third bending electromagnet 16 and a first magnetic field strength different from that of the third bending electromagnet 16. The third bending electromagnet 16 has a polarity identical to that of the second magnetic field strength and a second magnetic field strength different from that of the second bending electromagnet 15. This makes it possible to select a radio-frequency electric field having a low acceleration frequency. For example, a radio-frequency cavity having a low acceleration frequency of approximately 500 MHz can be used, whereby a continuous wave electron beam having a large average current can be accelerated.

In addition, without satisfying the condition that the energy gain for each circumferential pass must be approximately a multiple of the electron rest energy, which is essential in the microtron acceleration, the continuous wave electron beam can be accelerated, and the parameter has more degrees of freedom. As a result, the electrical efficiency can be increased. Moreover, the loss caused by the wall in the electron-beam accelerating unit 13 can be decreased, which increases the electrical efficiency.

By forming surfaces of the second and third bending electromagnets 15 and 16 which are opposed to the first bending electromagnet 14 so that they have a stepped magnetic pole shape, the paths 17 of the continuous wave electron beam, which are opposed to the electron-beam accelerating unit 13, can be maintained to be almost in parallel to the electron-beam accelerating unit 13.

According to the first embodiment, there is provided a continuous wave electron-beam accelerating method for the continuous wave electron-beam accelerator including the electron beam generator 11 for generating a continuous wave electron beam, the electron-beam accelerating unit 13 for accelerating the continuous wave electron beam, the first electron-beam bending unit 14,15,16 that is provided close to one end of the electron-beam accelerating unit 13 and that bends the accelerated continuous wave electron beam, and the second electron bending unit 14,15,16 that is provided close to the other end of the electron-beam accelerating unit 13 and that bends the accelerated continuous wave electron beam. The phase of the continuous wave electron beam injected into the electron-beam accelerating unit 13 the first time is accelerated adjusting the difference between the phase of the continuous wave electron beam in the electron beam generator 11 and the phase of the acceleration electric field in the electron-beam accelerating unit 13. The phase of the continuous wave electron beam injected into the electron-beam accelerating unit 13 the second time is accelerated adjusting the distance between the electron-beam accelerating unit 13 and the first electron-beam bending unit. The phase of the continuous wave electron beam injected into the electron-beam accelerating unit 13 the third time is accelerated adjusting the distance between the first electron-beam bending unit 14,15,16 and the second electron-beam bending unit 14,15,16. The phase of the continuous wave electron beam injected into the electron-beam accelerating unit 13 the fourth time and the fifth time is accelerated adjusting a ratio between magnetic field strengths and bending angles of the second and third bending electromagnets 15 and 16 in both electron-beam bending units 14,15,16. This makes it possible to adjust the acceleration phase of the continuous wave electron beam for each circumferential pass. Accordingly, without satisfying the condition that the energy gain for each circumferential pass must be approximately a multiple of the electron rest energy, which is essential in the microtron acceleration, the continuous wave electron beam can be accelerated, and a continuous wave electron beam having a broad acceleration phase width (approximately 20 degrees) can be accelerated. Moreover, the paths of the continuous wave electron beam, which are opposed to the electron-beam accelerating unit 13, can be maintained to be almost in parallel to the electron-beam accelerating unit 13.

Second Preferred Embodiment

In a second preferred embodiment of the present invention, similarly to the first embodiment, a continuous wave electron-beam accelerator that performs the acceleration of an electron beam up to 5 MeV, and a continuous wave electron-beam accelerating method thereof are described below.

Figure 5:
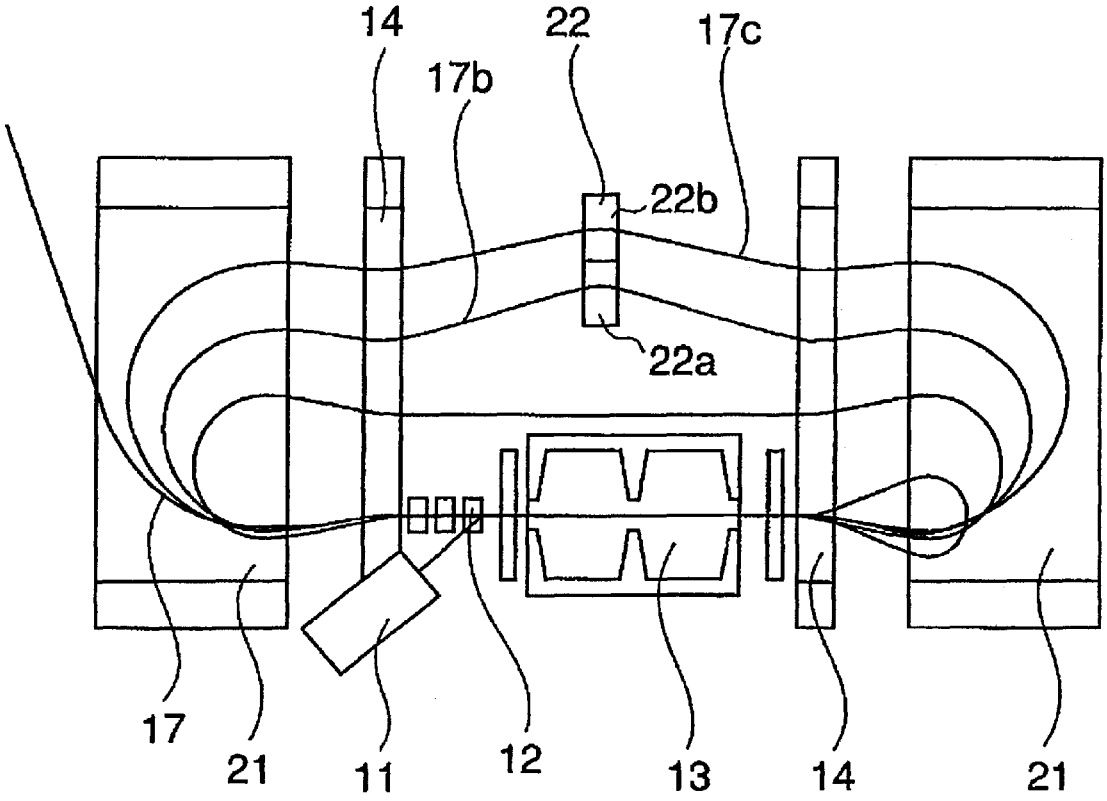
FIG. 5 is a schematic drawing showing a continuous wave electron-beam accelerator according to a second preferred embodiment of the present invention.

FIG. 5 shows the schematic structure of the continuous wave electron-beam accelerator according to the second embodiment. Specifically, FIG. 5 shows the schematic structure of a plane (path plane) on which a continuous wave electron beam of the continuous wave electron-beam accelerator is accelerated. In FIG. 5, reference numerals identical to those in FIG. 1 denote identical or corresponding components. Accordingly, a description of each identical or corresponding component is omitted.

The continuous wave electron-beam accelerator also includes electron-beam bending units 14,21,22 that form the paths 17 of a continuous wave electron beam by bending the accelerated continuous wave electron beam from the electron-beam accelerating unit 13 so that its passing direction changes. The electron-beam bending units are provided close to ends of the electron-beam accelerating unit 13. The electron-beam bending units consist of a first electron-beam bending unit (shown on the right side in FIG. 5) that is provided close to an end of the electron-beam accelerating unit 13 and that bends the accelerated continuous wave electron beam, a second electron-beam bending unit (shown on the left side in FIG. 5) that is provided close to the other end of the electron-beam accelerating unit 13, and a phase shifter magnet 22 as a third electron-beam bending unit that is provided between the first and second electron-beam bending units at a straight portion which is opposed to the electron-beam accelerating unit 13.

The first and second electron-beam bending units each consist of a reverse bending electromagnet 14 and a main bending electromagnet 21 having a polarity opposite to that of the reverse bending electromagnet 14. The phase shifter magnet 22 consists of two magnets 22*a* and 22*b* that generate dipole magnetic fields. The phase shifter magnet 22 is obtained by (1) using separate magnets, (2) using magnets having the same return yoke and separately winding a coil around each magnetic pole, (3) changing the gaps of magnetic poles, or (4) providing separate permanent magnets.

The electron beam generator 11 generates a continuous wave electron beam, and the path 17 of the continuous wave electron beam is formed by the reverse bending electromagnet 14, the main bending electromagnet 21, and the phase shifter magnet 22. Parameters on the reverse bending electromagnet 14, the main bending electromagnet 21, and the phase shifter magnet 22 are adjusted so that the path 17 of the continuous wave electron beam is almost identical in the electron-beam accelerating unit 13. The reverse bending electromagnet 14 operates so that it controls a continuous wave electron beam that has passed through it the first time to pass reversely through it on the same path again and so that it maintains the beam size of the circumferentially passing continuous wave electron beam in a predetermined range. After the continuous wave electron beam passes through the electron-beam accelerating unit 13 five times, it is led from the electron-beam accelerating unit 13 to the exterior.

The acceleration of the continuous wave electron beam is performed by the electron-beam accelerating unit 13, and the selection of the acceleration frequency and parameters is similar to the first embodiment. In the second embodiment, by generating dipole magnetic fields, using the phase shifter magnets 22*a* and 22*b* for adjusting the acceleration phase, the circumferential lengths of the path 17*b* of the continuous wave electron beam that circumferentially passes the fourth time and the path 17*c* of the continuous wave electron beam that circumferentially passes the fifth time are adjusted. The phase shifter magnets 22*a* and 22*b* are magnetized so that dipole magnetic fields are generated in portions through which the paths 17*b* and 17*c* pass. In the second embodiment, the phase shifter magnets 22*a* and 22*b,* in which the dipole magnetic fields are dominant, are shown. However, phase shifter magnets may be used that slightly have four-pole magnetic-field components in addition to the dipole magnetic fields.

The acceleration phase of the continuous wave electron beam that passes through the electron-beam accelerating unit 13 is adjusted below. Since an optimal acceleration phase of the continuous wave electron beam passing through the electron-beam accelerating unit 13 differs depending on each circumferential pass, the length of the circumferential path for each circumferential pass is controlled by the following steps:

(a) when the continuous wave electron beam is injected into the electron-beam accelerating unit 13 the first time, the difference between the phase of the continuous wave electron beam by the electron beam generator 11 and the phase of the acceleration electric field by the electron-beam accelerating unit 13 is adjusted;

(b) when the continuous wave electron beam is injected into the electron-beam accelerating unit 13 the second time, the distance between the electron-beam accelerating unit 13 and the first electron-beam bending unit is adjusted;

(c) when the continuous wave electron beam is injected into the electron-beam accelerating unit 13 the third time, the distance between the first electron-beam bending unit and the second electron-beam bending unit is adjusted; and (d) when the continuous wave electron beam is injected into the electron-beam accelerating unit 13 the fourth time and the fifth time, by changing the magnetic field strengths of the phase shifter magnets 22*a* and 22*b,* the circumferential length of each circumferential pass is adjusted.

In the second embodiment, by using the reverse bending electromagnet 14 to bend the continuous wave electron beam outward, and using the phase shifter magnet 22 to bend the continuous wave electron beam inward, the path of the continuous wave electron beam is formed.

The path 17 (in FIG. 5) of the continuous wave electron beam is an example of an acceleration path obtained by simulation of the continuous wave electron beam. FIG. 5 shows the result of simulating the central path of the continuous wave electron beam in the case that the acceleration phase, obtained when the continuous wave electron beam circumferentially passes the fifth time, is shifted by 55 degrees from an acceleration phase in the case that the second embodiment is not applied. The outward curved paths 17*b* and 17*c* that pass outside the electron-beam accelerating unit 13 are obtained when the circumferential length is adjusted by the phase shifter magnets 22*a* and 22*b*.

Figure 6:
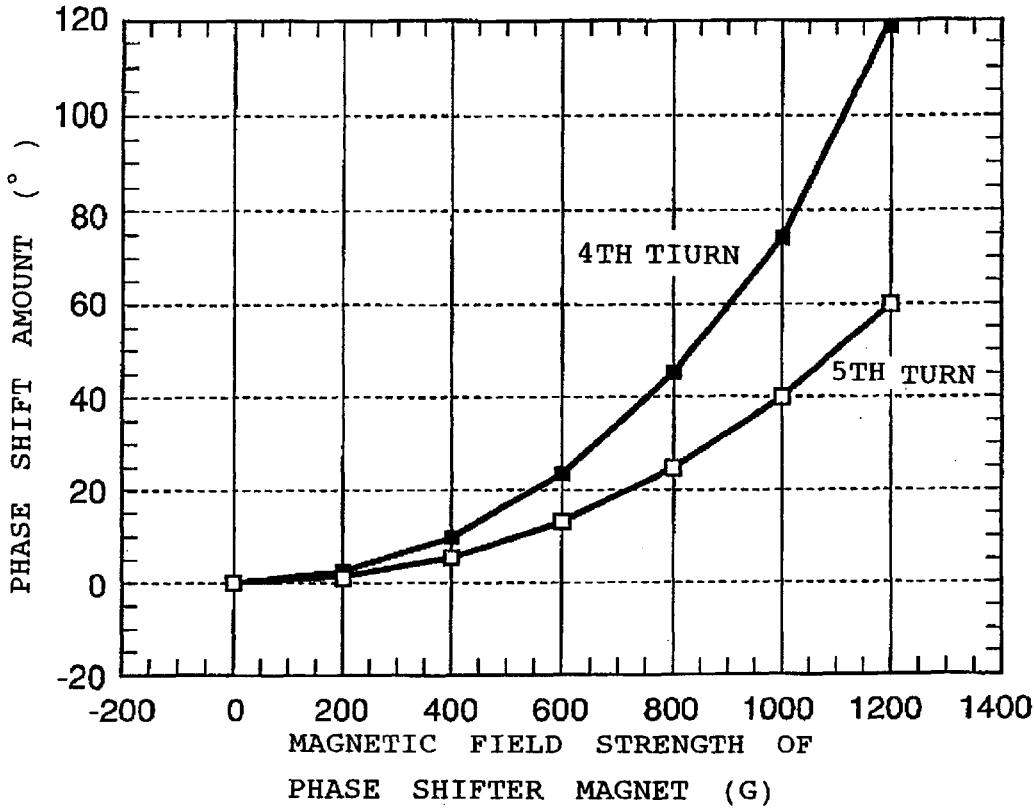
FIG. 6 is a graph illustrating the magnetic field strength of a phase shifter magnet and an acceleration-phase adjusting range, which are obtained by beam simulation.

FIG. 6 shows the results of simulating the required magnetic field strength of the phase shifter magnet 22 for adjusting the acceleration phases obtained when the continuous wave electron beam circumferentially passes the fourth time and the fifth time. As for the parameters, a phase shift amount of approximately 42 degrees is required. The graph in FIG. 6 indicates that the phase shift amount can be achieved by a magnetic field of 1000 gausses or slightly greater. It is assumed in calculation that each magnetic pole length (the length of a magnetic pole in the longitudinal direction) of the phase shifter magnets 22*a* and 22*b* is 10 centimeters.

As described above, according to the second embodiment, there is provided a continuous wave electron-beam accelerator including the electron beam generator 11 for generating a continuous wave electron beam, an electron-beam accelerating unit 13 for accelerating the continuous wave electron beam, and the electron-beam bending units for bending the accelerated continuous wave electron beam. The electron-beam bending units include the first electron-beam bending unit 14,21 that is provided close to one end of the electron-beam accelerating unit 13 and that bends the accelerated continuous wave electron beam, the second electron-beam bending unit 14,21 that is provided close to the other end of the electron-beam accelerating unit 13 on a side with the electron beam generator 11 and that bends the accelerated continuous wave electron beam, and the phase shifter magnets 22*a* and 22*b* as the third electron-beam bending unit for generating dipole magnetic fields which is provided between the first and second electron-beam bending units at a straight portion which is opposed to the electron-beam accelerating unit 13. This makes it possible to select a radio frequency cavity having a low acceleration frequency. For example, a radio frequency cavity having a low acceleration frequency of approximately 500 MHz can be used, whereby a continuous wave electron beam having a large average current can be accelerated.

In addition, without satisfying the condition that the energy gain for each circumferential pass must be approximately a multiple of the electron rest energy, which is essential in the microtron acceleration, the continuous wave electron beam can be accelerated. The loss caused by the wall in the electron-beam accelerating unit 13 can be decreased, whereby electrical efficiency can be increased. Moreover, a continuous wave electron beam having a broad acceleration phase width can be accelerated.

According to the second embodiment, there is also provided a continuous wave electron-beam accelerating method for the continuous wave electron-beam accelerator including the electron beam generator 11 for generating a continuous wave electron beam, an electron-beam accelerating unit 13 for accelerating the continuous wave electron beam, and the electron-beam bending units for bending the accelerated continuous wave electron beam. The electron-beam bending units include the first electron-beam bending unit 14,21 that is provided close to one end of the electron-beam accelerating unit 13 and that bends the accelerated continuous wave electron beam, the second electron-beam bending unit 14,21 that is provided close to the other end of the electron-beam accelerating unit 13 on a side with the electron beam generator 11 and that bends the accelerated continuous wave electron beam, and the phase shifter magnets 22*a* and 22*b* as the third electron-beam bending unit for generating dipole magnetic fields which-is provided between the first and second electron-beam bending units at a straight portion which is opposed to the electron-beam accelerating unit 13. The acceleration phase of the continuous wave electron beam injected into the electron-beam accelerating unit 13 the first time is adjusted by adjusting the difference between the phase of the continuous wave electron beam in the electron beam generator 11 and the phase of the acceleration electric field of the electron-beam accelerating unit 13. The acceleration phase of the continuous wave electron beam injected into the electron-beam accelerating unit 13 the second time is adjusted by adjusting the distance between the electron-beam accelerating unit 13 and the first electron-beam bending unit. The acceleration phase of the continuous wave electron beam injected into the electron-beam accelerating unit 13 the third time is adjusted by adjusting the distance between the first and second electron-beam bending units. The acceleration phase of the continuous wave electron beam injected into the electron-beam accelerating unit 13 the fourth or subsequent time is adjusted by changing the magnetic field strength of the third electron-beam bending unit. This makes it possible to adjust the acceleration phase of the continuous wave electron beam for each circumferential pass. Accordingly, without satisfying the condition that the energy gain for each circumferential pass must be approximately a multiple of the electron rest energy, which is essential in the microtron acceleration, the continuous wave electron beam can be accelerated, and a continuous wave electron beam having a broad acceleration phase width (approximately 20 degrees) can be accelerated.

Third Preferred Embodiment

In the first and second embodiments, a CW beam that synchronizes with a radio-frequency electric field is injected from the electron beam generator 11. However, an ejected electron beam of a direct current (DC) type may be generated, as described in a third embodiment of the present invention, and the third embodiment has operations and advantages similar to those in the first and second embodiments. For example, when a thermoelectron-injecting type electron gun is used, it can generate a direct-current electron beam having approximately 3 $A/cm^2$. In the third embodiment, it is assumed that a direct-current electron beam having a radius of approximately 2 mm is used. Thus, from the electron gun, a DC-type direct-current electron beam having approximately 380 mA can be led.

Since it is assumed in the third embodiment that the acceleration phase width is approximately 20 degrees (similar to that in the first and second embodiments), acceleration using approximately an average current value in which 380 mA×20/360=21 mA can be performed. For example, when acceleration up to 5 MeV is performed, a high intensity direct-current electron beam having approximately 105 kW can be obtained. Also, the need for adjusting both the phase of the continuous wave electron beam and the phase of the radio-frequency electric field as in the first and second embodiments is eliminated. When a DC electron beam is generated, only part (approximately 20/360 degrees) of the generated DC electron beam can be accelerated. Thus, the efficiency is low, and a high-output high-voltage power supply is required. In addition, since the life of the electron gun is shortened, the first and second embodiments are preferable.

Fourth Preferred Embodiment

In the first and second embodiments, acceleration up to 5 MeV is performed by allowing the continuous wave electron beam to pass through the electron-beam accelerating unit 13 five times. However, in a fourth preferred embodiment of the present invention, by allowing the continuous wave electron beam to pass through the electron-beam accelerating unit 13 six times, acceleration up to 5 MeV may be performed, which provides operations and advantages similar to those in the first and second embodiments. For example, when using the condition that the frequency is set to 500 MHz, the acceleration energy is 5 MeV, the number of cells is set to 2, the acceleration voltage is 0.84 kW, and the number of times the electron beam passes through the radio-frequency cavity in the electron-beam accelerating unit 13 is set to 6, the loss caused by the wall in the electron-beam accelerating unit 13 is approximately 40 kW. When the fourth embodiment is compared with the first and second embodiments, a continuous wave electron-beam accelerator having high electrical efficiency is realized.

The acceleration phase of the electron beam injected into the electron-beam accelerating unit 13 the sixth time is adjusted by the following technique similar to the cases that the electron beam injected into the electron-beam accelerating unit 13 the fourth time and the fifth time. In the case shown in FIG. 1, among the first, second, and third bending electromagnets 14, 15, and 16, the ratio and the bending angle of the bending electromagnets 15 and 16, which have the same polarity, are adjusted. The adjustment of the bending angle is performed such that the two (magnetic-pole) steps 16*a* and 16*b* formed in the continuous wave-electron-beam-exit portion of the third bending electromagnet 16 are formed into three steps that are obtained by adding one step in the fourth embodiment. Also, in the arrangement shown in FIG. 5, by changing the magnetic field strength of the phase shifter magnets 22*a* and 22*b*, the circumferential length is adjusted.

Since the continuous wave electron beam is required to pass the electron-beam accelerating unit 13 six times, the first, second, and third bending electromagnets 14, 15, and 16, the main bending electromagnet 21, and the phase shifter magnet 22 are slightly larger in size than those in the first and second embodiments.

If the continuous wave electron beam can be allowed to pass through the electron-beam accelerating unit 13 seven or more times, the electrical efficiency is increased more. Nevertheless, the increase is limited because a decrease in the acceleration voltage of the electron-beam accelerating unit 13 shifts the acceleration phase while the electron beam is passing through the electron-beam accelerating unit 13 to cause a deceleration phase. The limit is dependent on the injection energy and the distribution of the energy of the electron beam that can be accelerated.

Fifth Preferred Embodiment

In the first embodiment, acceleration up to 5 MeV is performed by allowing the continuous wave electron beam to pass through the electron-beam accelerating unit 13 five times. In a fifth preferred embodiment of the present invention, a continuous wave electron-beam accelerator that performs acceleration up to 5 MeV by allowing the continuous wave electron beam to pass through the electron-beam accelerating unit 13 six times, and a continuous wave electron-beam accelerating method thereof are described. In the fifth embodiment, it is assumed that the acceleration voltage is approximately 0.9 MV. A radio-frequency electric field having a frequency around 500 MHz is used.

Figure 7:
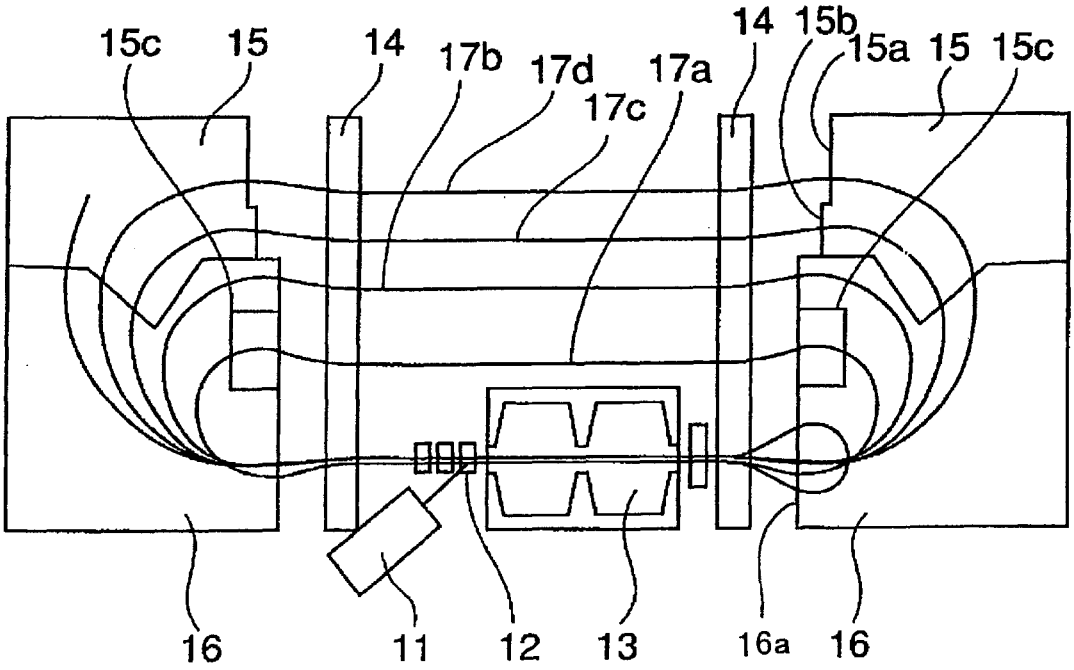
FIG. 7 is a schematic drawing showing a continuous wave electron-beam accelerator according to a fifth preferred embodiment of the present invention.

FIG. 7 illustrates the schematic structure of the continuous wave electron-beam accelerator according to the fifth embodiment, and specifically illustrates a plane (path plane) on which a continuous wave electron beam of the continuous wave electron-beam accelerator is accelerated. In FIG. 7, reference numerals identical to those in FIG. 1 denote identical or corresponding components. Accordingly, a description of each identical or corresponding component is omitted.

In the fifth embodiment, electron-beam bending units include a first electron-beam bending unit (shown on the right side in FIG. 7) that is provided close to an end of the electron-beam accelerating unit 13 and that bends an accelerated electron beam, and a second electron-beam bending unit (shown on the left side in FIG. 7) that is provided close to the other end of the electron-beam accelerating unit 13 on a side with an electron beam generator 11 and that bends the accelerated continuous wave electron beam.

FIGS. 1 and 7 differ in the arrangement of the second and third bending electromagnets 15 and 16. In the fifth embodiment, the magnetic field strength of the third bending electromagnet 16 is set to be weaker than that of the second bending electromagnet 15. Accordingly, in order that the electron-beam accelerating unit 13 and the paths 17 of the continuous wave electron beam, which is opposed to the electron-beam accelerating unit 13, may be almost in parallel to the electron-beam accelerating unit 13, the path length in the third bending electromagnet 16 must be increased. The continuous wave-electron-beam-exit portion of the second bending electromagnet 15 is formed to have magnetic-pole steps 15*a* and 15*b* shown in FIG. 7, and the third bending electromagnet 16 is extended from the step 15*b*, as denoted by reference numeral 16*a*. In a portion of the extended part 16*a* where the third turn of the continuous wave electron beam passes, the second bending electromagnet 15*c* is provided. The first and second electron-beam bending units are identical in shape and are symmetrically provided.

Although the steps 15*a*,15*b*,16*a* extend, the path length in the third bending electromagnet 16 must be shortened depending on the parameters. In this case, a portion at which the continuous wave electron beam enters the third bending electromagnet 16 has a magnetic pole having a retracted shape with respect to the step 15*b*.

Figure 8:
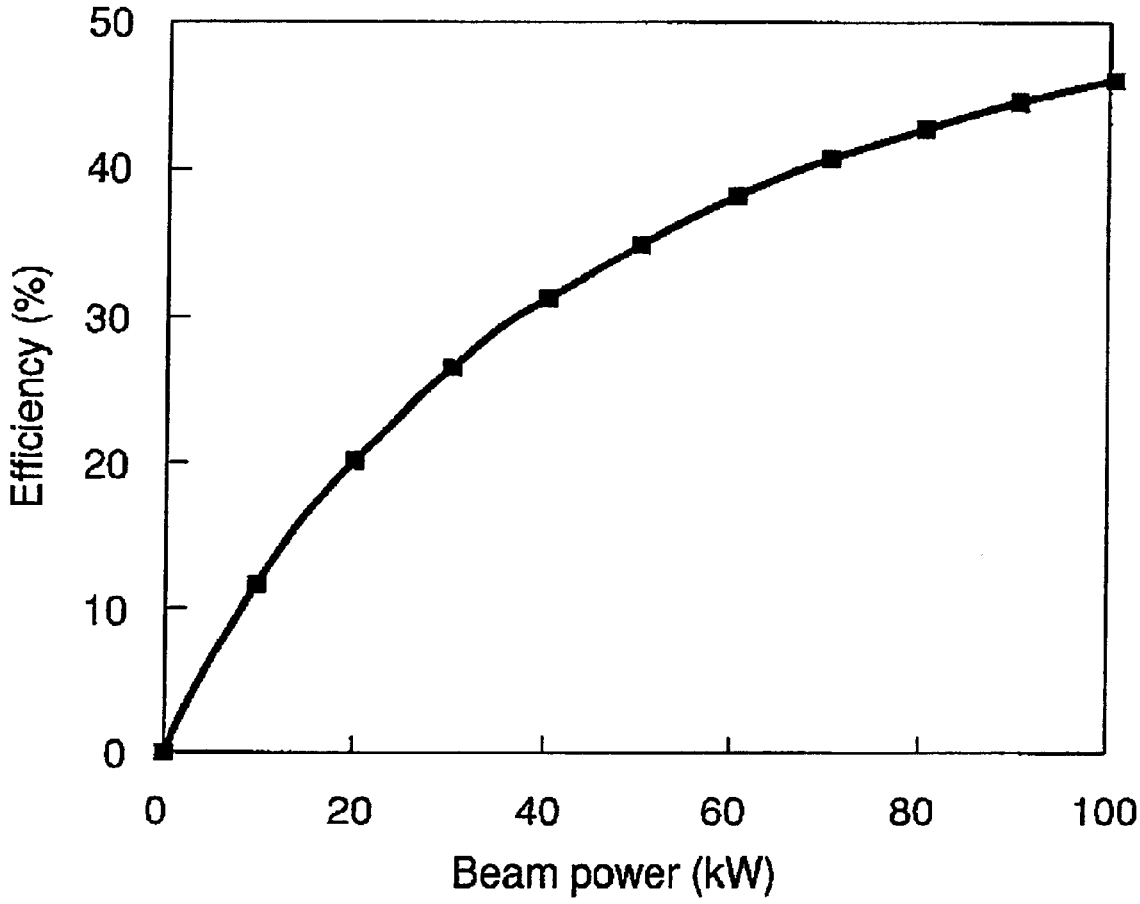
FIG. 8 is a graph illustrating the relationship between electron beam power and electrical efficiency in a case in which an electron beam is accelerated up to 5 MeV in the continuous wave electron-beam accelerator shown in FIG. 7.

As a radio-frequency power supply for the continuous wave electron-beam accelerator according to the fifth embodiment, for example, a klystron power supply, an IOT power supply, or the like, can be used. The use of the IOT reduces power required for obtaining a 30-kW beam, and achieves an electrical efficiency of more than 25%. The electrical efficiency is defined as a quotient obtained by dividing the power of the generated electron beam by the required electric power. When a 100-kW electron beam is obtained, a high-electrical-efficiency continuous wave electron-beam accelerator having an electrical efficiency of approximately 50% is realized, which is beyond the concept of the conventional electron-beam accelerator. FIG. 8 shows the relationship between the electron-beam power and the electrical efficiency that are obtained when the electron beam is accelerated up to 5 MeV.

In the fifth embodiment, the acceleration phase of the continuous wave electron beam passing through the electron-beam accelerating unit 13 is adjusted as shown below. Since an optimal acceleration phase of the continuous wave electron beam passing through the electron-beam accelerating unit 13 differs depending on each circumferential pass, the length of the circumferential path for each circumferential pass is controlled by the following steps:

(a) when the continuous wave electron beam is injected into the electron-beam accelerating unit 13 the first time, the difference between the phase of the continuous wave electron beam in the electron beam generator 11 and the phase of the acceleration electric field in the electron-beam accelerating unit 13 is adjusted;

(b) when the continuous wave electron beam is injected into the electron-beam accelerating unit 13 the second time, the distance between the electron-beam accelerating unit 13 and the first electron-beam bending unit is adjusted;

(c) when the continuous wave electron beam is injected into the electron-beam accelerating unit 13 the fourth time, the distance between the first electron-beam bending unit and the second electron-beam bending unit is adjusted; and (d) when the continuous wave electron beam is injected into the electron-beam accelerating unit 13 the third time, the fifth time, and the sixth time, the circumferential length is adjusted by adjusting a ratio (the ratio between the magnetic field strengths of the second bending electromagnet 15 and the third bending electromagnet 16) between the magnetic field strengths of bending electromagnets having the same polarity in the electron-beam bending units and a bending angle.

The adjustment in the above the step (c) is not limited to the fourth time, but the adjustment in the above step (c) may be performed for the predetermined time after the fourth time. For example, when adjustment using the above step (c) is performed the fifth time, for the time excluding the time for which adjustment using the above step (c) is performed the third time or thereafter, adjustment using the above step (d) may be performed the third time, the fourth time, and the sixth time. For which time the adjustment of the phase is performed in the above step (c) depends on the electromagnetic field in the electron-beam accelerating unit 13. One that broadens a variable range of parameters and that can accelerate an electron beam having a broader acceleration phase is selected.

The adjustment of the acceleration phase of the continuous wave electron beam is possible since it is performed by adjusting timing on the continuous wave electron beam, and adjusting the arrangement of the electron-beam accelerating unit 13 and the first and second electron-beam bending units.

Concerning the possibility of the adjustment of the acceleration phase of the continuous wave electron beam using the above step (d), computer-simulated results are described below.

The path 17 (shown in FIG. 7) of the continuous wave electron beam is an example of an acceleration path obtained by simulation, and shows the result of simulating the central path of the continuous wave electron beam in the case where the acceleration phase of the continuous wave electron beam obtained, for example, the third time, the fifth time, and the sixth time, is shifted by 55 degrees from the acceleration phase of the continuous wave electron beam obtained when the electron-beam bending units according to the present invention are not employed. The paths 17*a*, 17*b*, 17*c*, and 17*d* of the continuous wave electron beam, which passes outside the electron-beam accelerating unit 13 the third time, the fourth time, the fifth time, and the sixth time, are greatly separated. In other words, the distance of the paths between one time and another is 10 cm or greater in a magnet-dividing portion, and is achieved by forming electromagnets having different magnetic gaps.

As described above, according to the fifth embodiment, there is provided a continuous wave electron-beam accelerating method for a continuous wave electron-beam accelerator including the electron beam generator 11 for generating a continuous wave electron beam, an electron-beam accelerating unit 13 for accelerating the continuous wave electron beam, the first electron-beam bending unit 14,15,16 that is provided close to an end of the electron-beam accelerating unit 13 and that bends the accelerated continuous wave electron beam, and the second electron-beam bending unit 14,15,16 that is provided close to the other end of the electron-beam accelerating unit 13 on a side with the electron-beam accelerating unit 13 and that bends the accelerated continuous wave electron beam. The acceleration phase of the continuous wave electron beam injected into the electron-beam accelerating unit 13 the first time is adjusted by adjusting the difference between the phase of the continuous wave electron beam in the electron beam generator 11 and the phase of the acceleration electric field in the electron-beam accelerating unit 13. The acceleration phase of the continuous wave electron beam injected into the electron-beam accelerating unit 13 the second time is adjusted by adjusting the distance between the electron-beam accelerating unit 13 and the first electron-beam bending unit. The acceleration phase of the continuous wave electron beam injected into the electron-beam accelerating unit 13 the fourth time is adjusted by adjusting the distance between the first and second electron-beam bending units. The acceleration phase of the continuous wave electron beam injected into the electron-beam accelerating unit 13 the third, fifth, or sixth time is adjusted by adjusting a ratio between the bending electromagnets 15 and 16 having the same polarity in the first and second electron-beam bending units, and the bending angles thereof. This makes it possible to adjust the acceleration phase of the continuous wave electron beam for each circumferential pass. Accordingly, without satisfying the condition that the energy gain for each circumferential pass must be approximately a multiple of the electron rest energy, which is essential in the microtron acceleration, the continuous wave electron beam can be accelerated. In addition, a continuous wave electron beam having a broad acceleration phase width (approximately 30 degrees) can be accelerated, so that acceleration by a large current is possible. Moreover, the path of the continuous wave electron beam, which is opposed to the electron-beam accelerating unit 13, can be maintained to be almost in parallel to the electron-beam accelerating unit 13.

The continuous wave electron-beam accelerator according to the fifth embodiment provides operations and advantages similar to those in the first embodiment.

Sixth Preferred Embodiment

In a sixth preferred embodiment of the present invention, a continuous wave electron-beam accelerator that Ad performs acceleration up to 5 MeV by allowing the continuous wave electron beam to pass through the electron-beam accelerating unit 13 five times, and a continuous wave electron-beam accelerating method thereof are described below.

In the sixth embodiment, it is assumed that the acceleration voltage is approximately 1.0 MV. A radio-frequency electric field having a frequency around 500 MHz is used.

Figure 9:
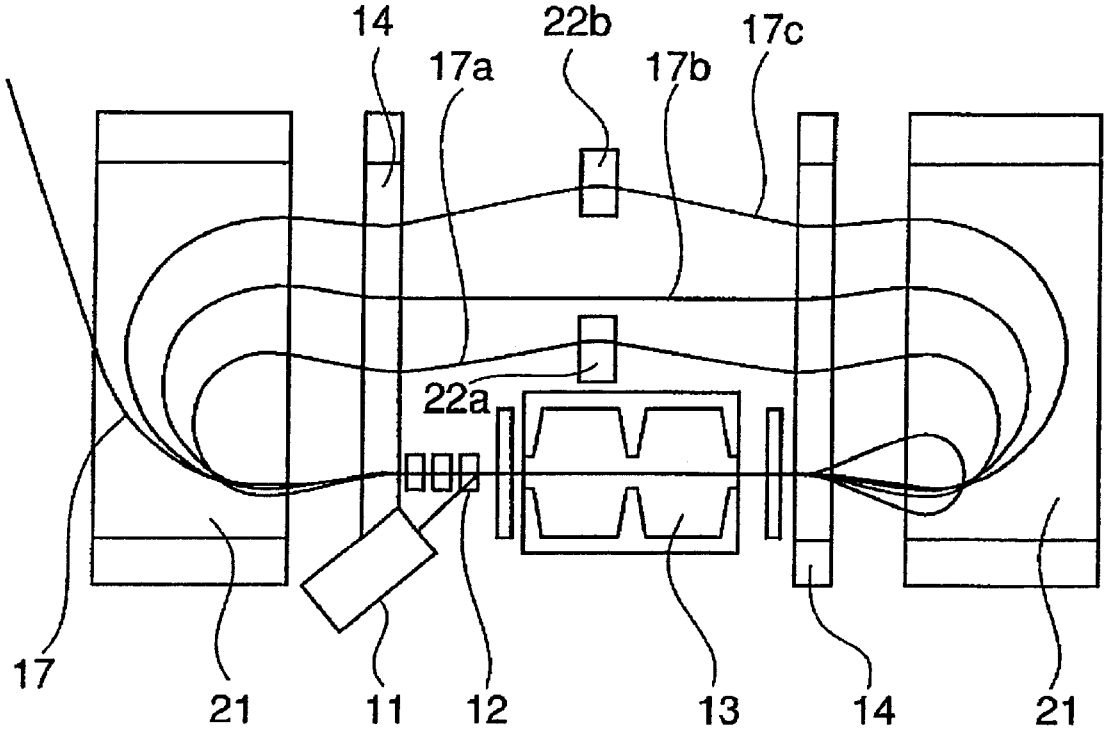
FIG. 9 is a schematic drawing showing a continuous wave electron-beam accelerator according to a sixth preferred embodiment of the present invention.
Figure 10:
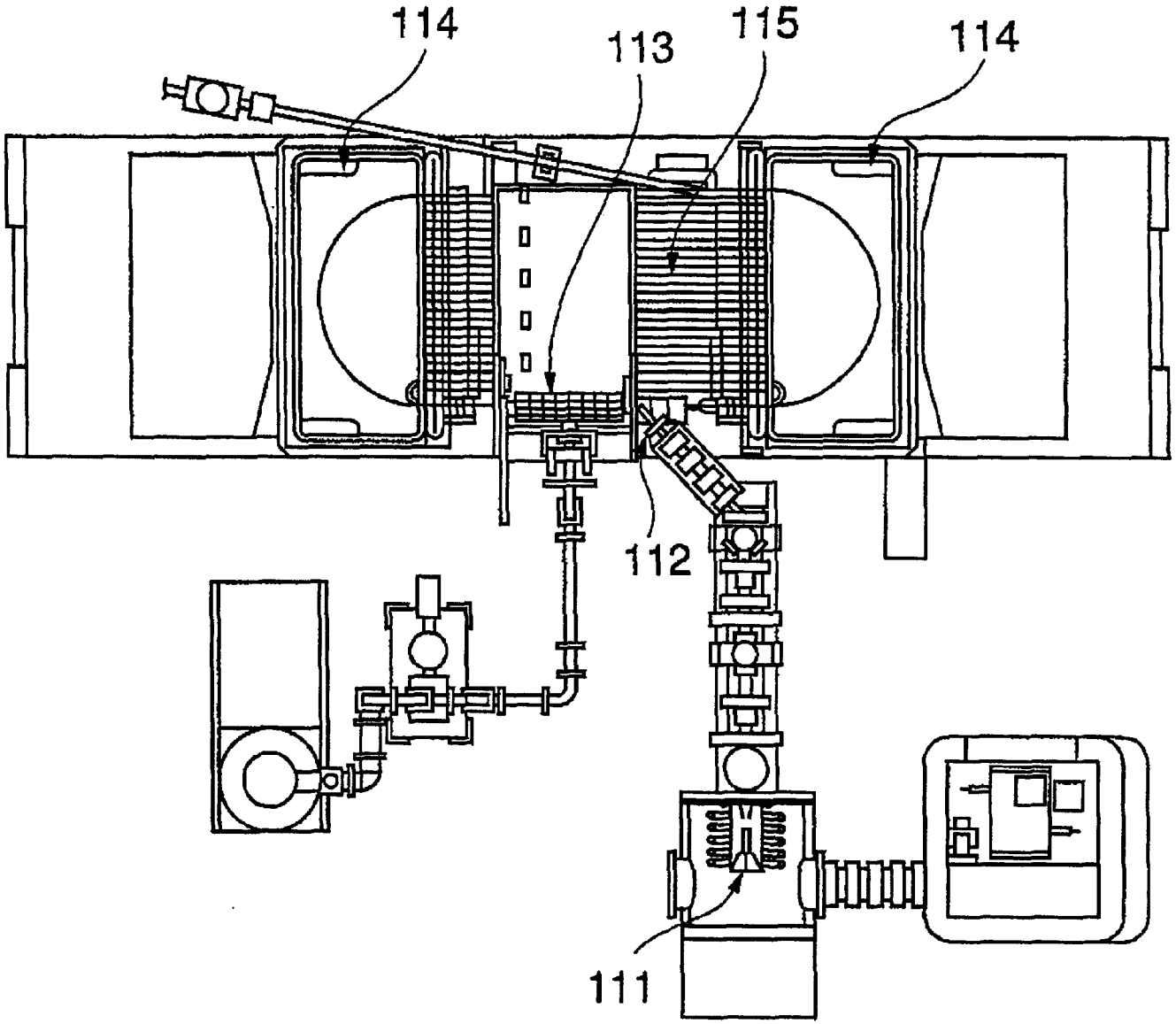
FIG. 10 is an illustration of a conventional electron-beam accelerator.

FIG. 9 illustrates the schematic structure of the continuous wave electron-beam accelerator according to the sixth embodiment, and specifically illustrates a plane (path plane) on which a continuous wave electron beam of the continuous wave electron-beam accelerator is accelerated. In FIG. 9, reference numerals identical to those in FIG. 1 denote identical or corresponding components. Accordingly, a description of each identical or corresponding component is omitted.

In the sixth embodiment, electron-beam bending units include a first electron-beam bending unit (shown on the right side in FIG. 9) that is provided close to an end of the electron-beam accelerating unit 13 and that bends an accelerated electron beam, a second electron-beam bending unit (shown on the left side in FIG. 9) that is provided close to the other end of the electron-beam accelerating unit 13 on a side with an electron beam generator 11 and that bends the accelerated continuous wave electron beam, and phase shifter magnets 22*a* and 22*b* that constitute a third electron-beam bending unit, that is provided between the first and second electron-beam bending units at a straight portion which is provided opposing the electron-beam accelerating unit 13.

FIGS. 5 and 9 differ in the arrangement of the phase shifter magnets 22*a* and 22*b*. In the arrangement shown in FIG. 9, the phase shifter magnets 22*a* and 22*b*, which are provided for adjusting the acceleration phase, are controlled to generate dipole magnetic fields, and the circumferential length of the path 17*a* of the continuous wave electron beam that circumferentially passes the third time and the circumferential length of the path 17*c* of the continuous wave electron beam that circumferentially passes the fifth time are adjusted.

The electron beam generator 11 is controlled to generate the continuous wave electron beam, and the paths 17 of the continuous wave electron beam is formed by a reverse bending electromagnet 14, a main bending magnet 21, and the phase shifter magnets 22*a* and 22*b*. Parameters on the reverse bending electromagnet 14, the main bending magnet 21, and the phase shifter magnets 22*a* and 22*b* are adjusted so that the paths 17 of the continuous wave electron beam is almost identical in the electron-beam accelerating unit 13. The reverse bending electromagnet 14 operates so that it controls a continuous wave electron beam that has passed through it the first time to pass reversely through it on the same path again and so that it maintains the beam size of the circumferentially passing continuous wave electron beam in a predetermined range. After the continuous wave electron beam passes through the electron-beam accelerating unit 13 five times, it is led from the electron-beam accelerating unit 13 to the exterior.

The continuous wave electron beam is accelerated by the electron-beam accelerating unit 13, and the acceleration frequency and parameter selection are similar to those in the first embodiment. In the sixth embodiment, by controlling the phase shifter magnets 22*a* and 22*b*, which are provided for adjusting the acceleration phase, to generate dipole magnetic fields, the circumferential length of the path 17*a* of the continuous wave electron beam that circumferentially passes the third time and the circumferential length of the path 17*c* of the continuous wave electron beam that circumferentially passes the fifth time are adjusted. The phase shifter magnets 22*a* and 22*b* are magnetized so that dipole magnetic fields are generated in portions through which the paths 17*a* and 17*c* pass. In the sixth embodiment, the phase shifter magnets 22*a* and 22*b*, in which the dipole magnetic fields are dominant, are shown. However, phase shifter magnets may be used that slightly have four-pole magnetic-field components in addition to the dipole magnetic fields.

The acceleration phase of the continuous wave electron beam passing through the electron-beam accelerating unit 13 is adjusted as described below. Since an optimal acceleration phase of the continuous wave electron beam injected into the electron-beam accelerating unit 13 differs depending on each circumferential pass, the length of the circumferential path for each circumferential pass is controlled by the following steps:

(a) when the continuous wave electron beam is injected into the electron-beam accelerating unit 13 the first time, the difference between the phase of the continuous wave electron beam in the electron beam generator 11 and the phase of the acceleration electric field in the electron-beam accelerating unit 13 is adjusted;

(b) when the continuous wave electron beam is injected into the electron-beam accelerating unit 13 the second time, the distance between the electron-beam accelerating unit 13 and the first electron-beam bending unit is adjusted;

(c) when the continuous wave electron beam is injected into the electron-beam accelerating unit 13 the fourth time, the distance between the first electron-beam bending unit and the second electron-beam bending unit is adjusted; and (d) when the continuous wave electron beam is injected into the electron-beam accelerating unit 13 the third or fifth time, by changing the magnetic field strength of the phase shifter magnets 22*a* and 22*b*, the circumferential length for each circumferential pass is adjusted.

The adjustment in the above step (c) is not limited to the fourth time, but the adjustment in the above step (c) may be performed for the predetermined time after the fourth time.

For example, when adjustment using the above step (c) is performed the fifth time, for the time excluding the time for which adjustment using the above step (c) is performed the third time or thereafter, adjustment using the above step (d) may be performed the third time and the fourth time. For which time the adjustment of the phase is performed in the above step (c) depends on the electromagnetic field in the electron-beam accelerating unit 13. One that broadens a variable range of parameters and that can accelerate an electron beam having a broader acceleration phase is selected.

In the sixth embodiment, by using the reverse bending electromagnet 14 to bend the continuous wave electron beam outward, and using the phase shifter magnets 22*a* and 22*b* to bend the continuous wave electron beam inward, the path of the continuous wave electron beam is formed.

The paths 17 (in FIG. 9) of the continuous wave electron beam are an example of an acceleration path obtained by simulating the continuous wave electron beam.

As described above, according to the sixth embodiment, there is provided a continuous wave electron-beam accelerating method for the continuous wave electron-beam accelerator including the electron beam generator 11 for generating a continuous wave electron beam, an electron-beam accelerating unit 13 for accelerating the continuous wave electron beam, and the electron-beam bending units for bending the accelerated continuous wave electron beam. The electron-beam bending units include the first electron-beam bending unit 14,21 that is provided close to one end of the electron-beam accelerating unit 13 and that bends the accelerated continuous wave electron beam, the second electron-beam bending unit 14,21 that is provided close to the other end of the electron-beam accelerating unit 13 on a side with the electron beam generator 11 and that bends the accelerated continuous wave electron beam, and the phase shifter magnets 22*a* and 22*b* as the third electron-beam bending unit for generating dipole magnetic fields which is provided between the first and second electron-beam bending units at a straight portion which is opposed to the electron-beam accelerating unit 13. The acceleration phase of the continuous wave electron beam injected into the electron-beam accelerating unit 13 the first time is adjusted by adjusting the difference between the phase of the continuous wave electron beam in the electron beam generator 11 and the phase of the acceleration electric field of the electron-beam accelerating unit 13. The acceleration phase of the continuous wave electron beam injected into the electron-beam accelerating unit 13 the second time is adjusted by adjusting the distance between the electron-beam accelerating unit 13 and the first electron-beam bending unit, the acceleration phase of the continuous wave electron beam injected into the electron-beam accelerating unit 13 the fourth time is adjusted by adjusting the distance between the first and second electron-beam bending units. The acceleration phase of the continuous wave electron beam injected into the electron-beam accelerating unit 13 the third or fifth time is adjusted by changing the magnetic field strength of the third electron-beam bending unit 22*a*, 22*b*. This makes it possible to adjust the acceleration phase of the continuous wave electron beam for each circumferential pass. Accordingly, without satisfying the condition that the energy gain for each circumferential pass must be approximately a multiple of the electron rest energy, which is essential in the microtron acceleration, the continuous wave electron beam can be accelerated. In addition, a continuous wave electron beam having a broad acceleration phase width (approximately 30 degrees) can be accelerated, so that acceleration by a large current is possible. Moreover, the path of the continuous wave electron beam, which is opposed to the electron-beam accelerating unit 13, can be maintained to be almost in parallel to the electron-beam accelerating unit 13.

The continuous wave electron-beam accelerator according to the sixth embodiment provides operations and advantages similar to those in the second embodiment.

Although the present invention has been described and illustrated in detail, it is clearly understood that the same is by way of illustration and example only and is not to be taken by way of limitation, the sprit and scope of the present invention being limited only by the terms of the appended claims.

What is claimed is:

1. A continuous wave electron-beam accelerator comprising:

electron-beam generating means for generating a continuous wave electron beam;

electron-beam accelerating means for accelerating the continuous wave electron beam;

first electron-beam bending means located close to a first end of said electron-beam accelerating means, said first electron-beam bending means bending the continuous wave electron beam accelerated by said electron-beam accelerating means; and second electron-beam bending means located close to a second end of said electron-beam accelerating means, said second electron-beam bending means bending the continuous wave electron beam accelerated by said electron-beam accelerating means, wherein:

each of said first electron-beam bending means and said second electron-beam bending means comprises a first bending electromagnet having a first surface opposed to a respective end of said electron-beam accelerating means, a second bending electromagnet and a third bending electromagnet which are discretely provided and are opposed to a second surface of said first bending electromagnet;

said first bending electromagnet is a reverse bending electromagnet having a polarity opposite that of said second and third bending electromagnets;

said second bending electromagnet has a polarity identical to that of said third bending electromagnet, and has a first magnetic field strength different from that of said third bending electromagnet; and said third bending electromagnet has a second magnetic field strength different from that of said second bending electromagnet.

2. The continuous wave electron-beam accelerator according to claim 1, wherein surfaces of said second bending electromagnet and said third bending electromagnet which are opposed to said first bending electromagnet are a magnetic pole having a stepped shape.

3. A continuous wave electron-beam accelerator comprising:

electron-beam generating means for generating a continuous wave electron beam;

electron-beam accelerating means for accelerating the continuous wave electron beam; and electron-beam bending means for bending the accelerated continuous wave electron beam, said electron-beam bending means comprising:

first electron-beam bending means located close to a first end of said electron-beam accelerating means, said first electron-beam bending means bending the continuous wave electron beam accelerated by said electron-beam accelerating means;

second electron-beam bending means located close to a second end of said electron-beam accelerating means, said second electron-beam bending means bending the continuous wave electron beam accelerated by said electron-beam accelerating means, and third electron-beam bending means located between said first electron-beam bending means and said second electron-beam bending means opposed to said electron-beam accelerating means, said third electron-beam bending means generating dipole magnetic fields for adjusting a circumferential path of the continuous wave electron beam when the continuous wave electron beam passes through the magnetic fields.

4. A continuous wave electron-beam accelerating method for a continuous wave electron-beam accelerator including electron-beam generating means for generating a continuous wave electron beam, electron-beam accelerating means for accelerating the continuous wave electron beam, first electron-beam bending means located close to a first end of said electron-beam accelerating means, said first electron-beam bending means bending the continuous wave electron beam accelerated by said electron-beam accelerating means, and second electron-beam bending means located close to a second end of said electron-beam accelerating means, said second electron-beam bending means bending the continuous wave electron beam, the continuous wave electron-beam accelerating method comprising:

(a) adjusting an acceleration phase of the continuous wave electron beam which is injected into said electron-beam accelerating means by adjusting a difference between the phase of the continuous wave electron beam in said electron-beam generating means and the phase of an acceleration electric field in said electron-beam accelerating means;

(b) adjusting the acceleration phase of the continuous wave electron beam which is injected into said electron-beam accelerating means by adjusting distance between said electron-beam accelerating means and said first electron-beam bending means;

(c) adjusting the acceleration phase of the continuous wave electron beam which is injected into said electron-beam accelerating means by adjusting distance between said first electron-beam bending means and said second electron-beam bending means; and (d) adjusting the acceleration phase of the continuous wave electron beam which is injected into said electron-beam accelerating means by adjusting a ratio between magnetic field strengths of identical-polarity bending electromagnets provided in said first electron-beam bending means and said second electron-beam bending means and bending angles thereof.

5. The continuous wave electron-beam accelerating method according to claim 4, wherein (a) is performed the first time the continuous wave electron-beam passes through the accelerator, (b) is performed the second time the continuous wave electron-beam passes through the accelerator, (c) is performed the third time the continuous wave electron-beam passes through the accelerator, and (d) is performed the fourth or subsequent time the continuous wave electron-beam passes through the accelerator.

6. The continuous wave electron-beam accelerating method according to claim 4, wherein (a) is performed the first time the continuous wave electron-beam passes through the accelerator, (b) is performed the second time the continuous wave electron-beam passes through the accelerator, (c) is performed for predetermined time after the fourth time the continuous wave electron-beam passes through the accelerator, and (d) is performed the third or subsequent time the continuous wave electron-beam passes through the accelerator, excluding the time when (c) is performed.

7. A continuous wave electron-beam accelerating method for a continuous wave electron-beam accelerator including electron-beam generating means for generating a continuous wave electron beam, electron-beam accelerating means for accelerating the continuous wave electron beam, first electron-beam bending means located close to a first end of said electron-beam accelerating means, said first electron-beam bending means bending the continuous wave electron beam accelerated by said electron-beam accelerating means, second electron-beam bending means located close to a second end of said electron-beam accelerating means, said second electron-beam bending means bending the continuous wave electron beam accelerated by said electron-beam accelerating means, and third electron-beam bending means located between said first electron-beam bending means and said second electron-beam bending means opposed to said electron-beam accelerating means, said third electron-beam bending means generating dipole magnetic fields for adjusting a circumferential path of the continuous wave electron beam when the continuous wave electron beam passes through the magnetic fields, the continuous wave electron-beam accelerating method comprising:

(a) adjusting an acceleration phase of the continuous wave electron beam which is injected into said electron-beam accelerating means by adjusting a difference between the phase of the continuous wave electron beam in said electron-beam generating means and the phase of an acceleration electric field in said electron-beam accelerating means;

(b) adjusting the acceleration phase of the continuous wave electron beam which is injected into said electron-beam accelerating means by adjusting distance between said electron-beam accelerating means and said first electron-beam bending means;

(c) adjusting the acceleration phase of the continuous wave electron beam which is injected into said electron-beam accelerating means by adjusting distance between said first electron-beam bending means and said second electron-beam bending means; and (d) adjusting the acceleration phase of the continuous wave electron beam which is injected into said electron-beam accelerating means by changing the magnetic field strengths of said third electron-beam bending means so as to adjust the length of the path of the continuous wave electron beam each time the continuous wave electron-beam passes through the accelerator.

8. The continuous wave electron-beam accelerating method according to claim 7, wherein (a) is performed the first time the continuous wave electron-beam passes through the accelerator, (b) is performed the second time the continuous wave electron-beam passes through the accelerator, (c) is performed the third time the continuous wave electron-beam passes through the accelerator, and (d) is performed the fourth or subsequent time the continuous wave electron-beam passes through the accelerator.

9. The continuous wave electron-beam accelerating method according to claim 7, wherein (a) is performed the first time the continuous wave electron-beam passes through the accelerator, (b) is performed the second time the continuous wave electron-beam passes through the accelerator, (c) is performed for predetermined time after the fourth time the continuous wave electron-beam passes through the accelerator, and (d) is performed the third or subsequent time the continuous wave electron-beam passes through the accelerator, excluding the time when (c) is performed.

* * * * *